US005992074A

United States Patent [19]

Ruger et al.

[11] Patent Number: 5,992,074

[45] **Date of Patent: *Nov. 30, 1999**

[54] MUZZLE-LOADED FIREARM WITH BOLT TRAVEL LIMITATION

[75] Inventors: William B. Ruger, Croydon, N.H.; James McGarry, Prescott, Ariz.

[73] Assignee: Sturm, Ruger & Company, Inc., Southport, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,606

[22] Filed: Oct. 31, 1997

[51] Int. Cl.[6] ..... F41C 9/08

[52] U.S. Cl. ..... 42/51; 42/16

[58] Field of Search ..... 42/51, 16; 89/1.3

[56] References Cited

U.S. PATENT DOCUMENTS

| | | | |
|---|---|---|---|
| 11,938 | 11/1854 | Maton . | |
| 26,475 | 12/1859 | Burton . | |
| 34,084 | 1/1862 | Woodward . | |
| 1,317,419 | 9/1919 | Bergman | 89/1.3 |
| 3,631,620 | 1/1972 | Ohira . | |
| 3,643,545 | 2/1972 | Nahas | 42/84 |
| 4,653,210 | 3/1987 | Poff, Jr. | 42/16 |
| 4,715,139 | 12/1987 | Rodney, Jr. | 42/51 |
| 5,561,934 | 10/1996 | Knight | 42/51 |
| 5,606,817 | 3/1997 | Sachse . | |
| 5,706,598 | 1/1998 | Johnston | 42/51 |
| 5,718,073 | 2/1998 | Sachse et al. | 89/1.3 |

FOREIGN PATENT DOCUMENTS

| | | | |
|---|---|---|---|
| 328496 | 10/1918 | Germany | 89/1.3 |
| 3308 | 11/1867 | United Kingdom . | |

OTHER PUBLICATIONS

Wickenden, Rifle: The Magazine For Shooters, Unorthodox Slug Rifle, 1978, pp. 36–43.

Abridgements of Specifications, Class 119, dated 1867–76 (cover and p. 122).

*Primary Examiner*—Stephen M. Johnson

*Attorney, Agent, or Firm*—Pennie & Edmonds LLP

[57] ABSTRACT

A muzzle-loading firearm having a bolt, a receiver, a striker mounted in the bolt and a breech plug or other part of the receiver carrying a percussion cap in which the bolt has an extension engageable with the breech plug to prevent inadvertent engagement of the striker and percussion cap when the plug is not properly seated. Further, the bolt extension may prevent bolt locking when the plug is not properly seated.

5 Claims, 2 Drawing Sheets

MUZZLE-LOADED FIREARM WITH BOLT TRAVEL LIMITATION

BACKGROUND OF THE INVENTION

Bolt operated muzzle-loading firearms have included receivers configured to engage the bolt after the bolt handle is moved forward and turned down. While bolts and their firing units have been placed selected distances from the percussion cap in the breech by so locking the bolt, prior bolt operated muzzle-loading firearms have permitted the bolt to be moved forward against the percussion cap, particularly if the nipple or breech plug biasing the percussion cap is not completely tightened fully into the barrel or receiver of the firearm.

SUMMARY OF THE INVENTION

Broadly, the present invention comprises a bolt travel restriction arrangement for a muzzle-loading firearm to limit bolt movement in the receiver to prevent the cocked striker from engaging the percussion cap when the striker is cocked, regardless of the position of the nipple or breech plug with the receiver.

A bolt extension which engages a breech plug located in the receiver provides a preferred bolt restriction arrangement.

BRIEF DESCRIPTION OF THE PREFERRED EMBODIMENTS

Figure 1:
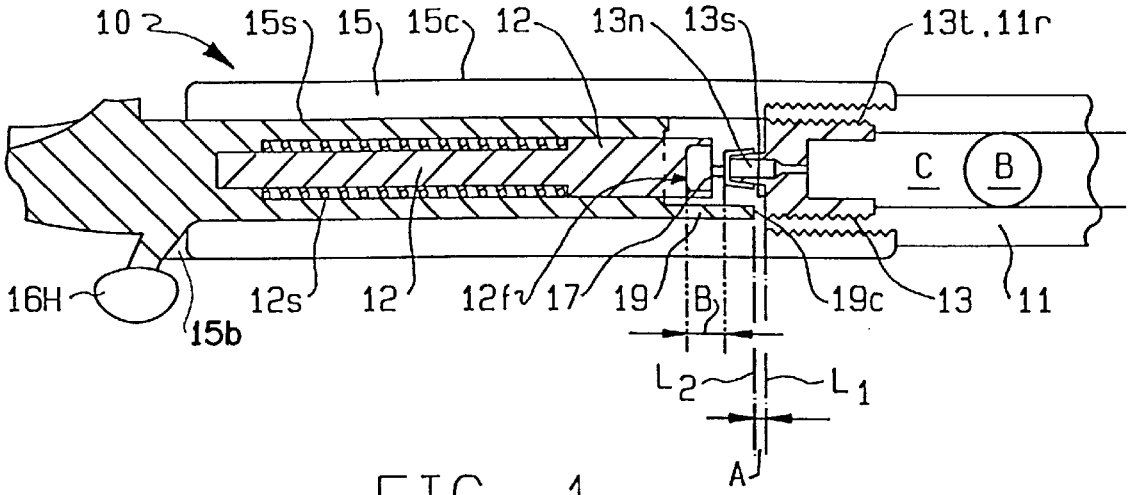
FIG. 1 is a partial sectional view showing the muzzle-loading firearm of the present invention.
Figure 2:
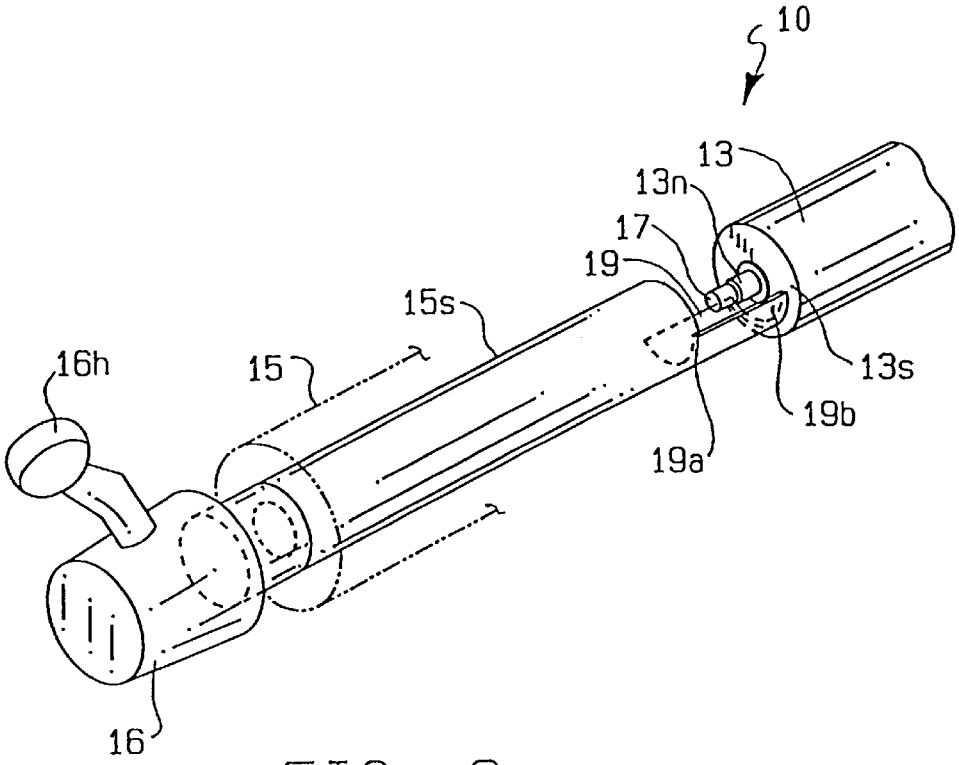
FIG. 2 is a perspective view of the bolt receiver in phantom and the breech plug without threading.
Figure 3:
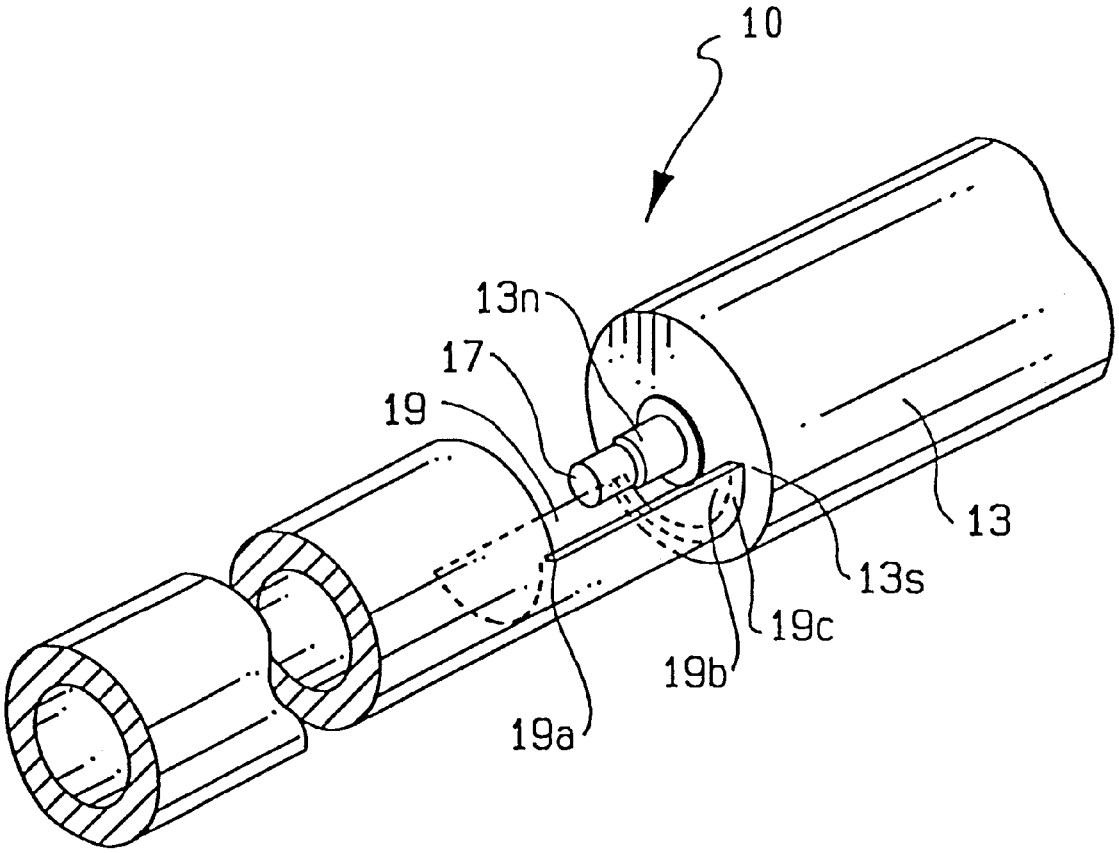
FIG. 3 is an enlarged perspective view of the bolt and breech plug.

In FIGS. 1–3, muzzle-loading firearm 10 includes barrel 11, receiver 15, bolt 16 and striker 12 within bolt 16 being urged forward by striker spring 12*s*. Bolt 16 has bolt handle 16*h* for reciprocating and turning in the interior space 15*s* of receiver 15 and striker 12 has striker face 12*f*. Also shown is percussion cap or other percussion cap 17 located in interior receiver space 15*s* on nipple 13*n* of breech plug 13. Plug 13 has threads 13*t* for threading engagement with threaded barrel recess 11*r*. Breech plug 13 includes rear surface 13*s* and nipple 13*n* to receive percussion cap 17.

Bolt 16 has a curved narrow extension 19 which functions to limit the forward travel of bolt 16 and its internal striker 12 when the bolt 16 is manipulated. Bolt extension has a curved surface 19*b* and face 19*c*. Distance B is the space between striker face 12*f* and percussion cap 17. Absent bolt extension 19, and if breech plug 13 was not screwed in place striker face 12*f* could be engaged with percussion cap 17 causing it to unintentionally or prematurely fire. Even if breech plug 13 becomes partially unscrewed moving percussion cap 17 rearward and closer to striker face 12*f* by distance A or other distance, percussion cap 17 remains spaced apart from striker face 12*f*. Distance A is the distance from line $L_1$, which indicates rear plug face 13*s* is properly seated, and Line $L_2$ which indicates the position of curved bolt extension face 19*c*, when bolt 16 is locked in this firing position. Distance A is approximately 0.010.

In operation muzzle-loader 10 is loaded by causing charge (C) and ball (B) to be moved down barrel 11 to their loaded locations as shown in FIG. 1. Next, bolt 16 is unlocked causing the striker 12 to be cocked by a mechanism not shown and drawn back permitting percussion cap 17 to be placed on breech plug nipple 13*n*. Bolt 16 is then moved forward. Once bolt 16 has been moved forward a sufficient distance it is turned and in handle lock slot 15*b*. At this time, striker 12 is held back in its cocked position by a mechanism not shown. As it is turned to lock, bolt 16 is cammed slightly forward by mechanism not shown. If breech plug 13 is not fully screwed in place, rotating and forward moving bolt extension face 19*c* will bind against breech plug face 13*s*, preventing bolt 16 from fully locking, thereby signalling the operator the breech plug is not fully tightened.

In addition, since extension 19 functions to maintain this distance between bolt 16's internally mounted and locked striker 12, and percussion cap 17, via front bolt extension surface 19*c* being in contact with breech plug rear surface 13*s*, vigorous forward motion of bolt 16 by the operator upon a partially, or even fully, unscrewed and percussion capped breech plug 13 cannot cause an unintentioned ignition of percussion cap 17.

We claim:

1. A muzzle-loading firearm having a receiver with a bolt reciprocally located therein which firearm is fired by releasing a striker against a removable percussion cap comprising a) said percussion cap located on a nipple in the receiver on a threaded breech plug in the barrel;

b) the bolt located in the receiver for reciprocation rearward and forward therein and having in the bolt said striker with a striker face which striker face has a cocked and an uncocked position; and c) extension means on said bolt which extension means are structurally part of the bolt and which extension means move with the bolt as the bolt reciprocates for controlling the spacing between the cocked striker face and the percussion cap, said extension means preventing the condition of the threaded breech plug when partially or fully unscrewed coming in contact with the striker face in its cocked position to engage said percussion cap, which condition would exist absent the extension means; and d) said extension means being spaced from the breech plug when such plug is properly screwed in place, thereby preventing unintentioned ignition caused by vigorous forward bolt movement against a partially or fully unscrewed said breech plug.

2. The muzzle-loading firearm of claim 1 in which said breech plug has a face in the receiver and in which the percussion cap is mounted on said breech plug and said means for controlling the spacing is abuttable with said breech plug face as the bolt moves forward and before the striker face strikes the percussion cap.

3. The muzzle-loading firearm of claim 1 in which said means for controlling spacing is a forward portion of the bolt.

4. The muzzle-loading firearm of claim 1 having in addition a bolt handle and a handle lock slot in the receiver and in which said means on said bolt for controlling the spacing between said striker face and said percussion cap also in addition determines the positioning between the bolt lock slot and the bolt handle, thereby preventing said bolt from locking in place in said lock slot if said breech plug which carries the percussion cap is not fully tightened.

5. The muzzle-loading firearm of claim 4 in which the said means for controlling spacing on the bolt does not engage the breech plug when the bolt is locked and the breech plug is properly seated.

* * * * *